US006535705B2

(12) United States Patent
Asakura et al.

(10) Patent No.: US 6,535,705 B2
(45) Date of Patent: Mar. 18, 2003

(54) PROCESS CARTRIDGE AND IMAGE FORMING APPARATUS USING THE SAME

(75) Inventors: Naoichi Asakura, Osaka (JP); Toru Matsui, Osaka (JP); Hideyuki Nukumi, Osaka (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/789,511

(22) Filed: Feb. 22, 2001

(65) Prior Publication Data

US 2001/0016126 A1 Aug. 23, 2001

(30) Foreign Application Priority Data

Feb. 23, 2000 (JP) ..... 2000-045858

(51) Int. Cl.[7] ..... G03G 15/00; G03G 21/18

(52) U.S. Cl. ..... 399/119; 399/111; 399/227

(58) Field of Search ..... 399/119, 111, 399/112, 114, 115, 116, 121, 125, 227; 347/138, 152

(56) References Cited

U.S. PATENT DOCUMENTS

| | | | | |
|---|---|---|---|---|
| 5,066,976 A | | 11/1991 | Kanagawa et al. | 399/111 |
| 5,221,943 A | | 6/1993 | Hasegawa | 399/111 |
| 5,347,343 A | | 9/1994 | Ohtsuka et al. | 399/111 |
| 5,899,602 A | * | 5/1999 | Noda et al. | 399/111 |
| 6,118,962 A | * | 9/2000 | Casper et al. | 399/119 |
| 6,229,974 B1 | * | 5/2001 | Noda | 399/111 |

FOREIGN PATENT DOCUMENTS

| | | | |
|---|---|---|---|
| JP | 62-149046 | | 9/1987 |
| JP | 63-100736 | | 6/1988 |
| JP | 08-185108 | * | 7/1996 |

* cited by examiner

*Primary Examiner*—Sophia S. Chen
(74) *Attorney, Agent, or Firm*—Morrison & Foerster LLP

(57) ABSTRACT

In order to provide a process cartridge which has a simple mechanism and can be easily positioned with respect to an apparatus body and securely mounted on the apparatus body even in a half-locked state or a half-inserted condition, the process cartridge 200 includes a unit 201, a positioning member 202, a holding member 203 and a restricting and releasing mechanism 204. The unit 201 includes an element used for an image forming process. The positioning member 202 has a positioning member which engages with an engagement portion 125, 126 formed on the image forming apparatus to position the process cartridge 200 at a predetermined mount position in the image forming apparatus. The holding member 203 holds the unit 201 to allow displacement of the unit 201 relative to the positioning member 202. The restricting and releasing mechanism 204 is arranged to restrict or release the displacement of the unit 201 relative to the positioning member 202.

22 Claims, 14 Drawing Sheets

PROCESS CARTRIDGE AND IMAGE FORMING APPARATUS USING THE SAME

This application is based on application Ser. No. 2000-45858 filed in Japan on Feb. 23, 2000, the contents of which are hereby incorporated by reference.

BACKGROUND OF THE INVENTION

The present invention relates to a process cartridge and an image forming apparatus using the same.

In an image forming apparatus used in a copying machine, a printer or the like, for the purposes of exchanging or repairing elements necessary for image forming processes, treating a jam or the like, process cartridges including the elements are detachably mounted on the image forming apparatus. Such process cartridges are necessary to be securely mounted and positioned on the image forming apparatus so as not to cause a maloperation.

U.S. Pat. No. 5,066,976 proposes such a mechanism that if a process cartridge is not perfectly push into an apparatus body, a part of holding member for holding the process cartridge protrudes out of an opening portion of grip, whereby it can be possible to judge whether or not the process cartridge is pushed into a predetermined position. Japanese Utility Model Laid-open publication No. 63-100736 proposes such a mechanism that when a cover is closed, a stopper mechanism provided on the cover pushes and fixes a process unit. Japanese Utility Model Laid-open publication No. 62-149046 proposes such a mechanism that a process unit detachably mounted so as to approach to and separate from a photosensitive is moved by a lever to position in place.

However, the positioning mechanisms of process cartridges proposed above have a disadvantage that when the process cartridges are positioned in a half-locked state or a half-inserted condition, or when the operation of the lever is omitted, the positioning of the process cartridges has to be conducted again, and also have a disadvantage that the push-fixation mechanism is complicated.

SUMMARY OF THE INVENTION

Accordingly, it is an object of the present invention to provide a process cartridge which has a simple mechanism and can be easily positioned with respect to an apparatus body and securely mounted on the apparatus body even in a half-locked state or a half-inserted condition, and also provide an image forming apparatus using the process cartridge.

According to a first aspect of the present invention, there is provided a process cartridge which can be mounted on and dismounted from an image forming apparatus, the process cartridge comprising:

a unit comprising an element used for an image forming process;

a positioning member having a positioning member which engages with an engagement portion formed on the image forming apparatus to position the process cartridge at a predetermined mount position in the image forming apparatus;

a holding member for holding the unit to allow displacement of the unit relative to the positioning member; and a restricting and releasing mechanism for restricting or releasing the displacement of the unit relative to the positioning member.

In the first aspect of the present invention, when the process cartridge is mounted on the image forming apparatus, the unit is secured by restricting the displacement of the unit relative to the positioning member, it is possible to stably surely mount the process unit. The term "displacement" in this specification of the present invention includes pivot, vibration, movement, swing and so on.

It is preferable that the engagement portion of the image forming apparatus comprises a recess or projection, and wherein the positioning member comprises a projection or recess which engages with the recess or projection of the engagement portion. In this case, the projection or recess of the positioning member may comprise a plurality of projections or recesses which are disposed around the holding member.

Preferably, the holding member comprises a screw member.

Preferably, the process cartridge further comprises a cover member for interlocking with the restricting and releasing mechanism to cover or open a specific portion of the unit. In this case, the element may comprise a toner container and a developing roller, and cover member may cover or open the developing roller.

Preferably, the restricting and releasing mechanism comes into contact with a member provided on the image forming apparatus and operates. In this case, the restricting and releasing mechanism may operate when the process cartridge is mounted on and dismounted from the image forming apparatus. Alternately, the restricting and releasing mechanism mat operate when the process cartridge is mounted on the image forming apparatus.

According to a second aspect of the present invention, there is provided a process cartridge which can be mounted on and dismounted from an image forming apparatus, the process cartridge comprising:

a unit comprising an element used for an image forming process;

a positioning member having a first positioning member which engages with an engagement portion formed on the image forming apparatus to position the process cartridge at a first predetermined position in the image forming apparatus; and a first pressed portion which is pressed by a first press portion provided on the image forming apparatus when the process cartridge is moved from the first predetermined position to a second predetermined position to position the process cartridge at the second predetermined position.

In the second aspect of the present invention, when the process cartridge moves in the image forming apparatus, the first pressed portion of the process cartridge is pressed by the first press portion of the image forming apparatus and positioned in place, whereby the process cartridge can be securely mounted in the predetermined position even in an incompletely mounted condition.

It is preferable that the engagement portion of the image forming apparatus comprises a recess or projection, and wherein the positioning member comprises a projection or recess which engages with the recess or projection of the engagement portion.

Preferably, the first pressed portion is provided on the positioning member.

preferably, the process cartridge further comprises a second pressed portion which is pressed by a second press portion provided on a cover of the image forming apparatus when closing the cover, the process cartridge is positioned at the first predetermined position by pressing the second press portion on the second pressed portion. In this case, the second pressed portion may be provided on the positioning member. The second pressed portion may be the first pressed portion.

Preferably, the process cartridge may further comprises a third pressed portion which is pressed by a third press portion provided on the image forming apparatus when the process cartridge is moved from the second predetermined position to a third predetermined position to position the process cartridge at the third predetermined position. In this case, the pressing direction by the third press portion may be substantially perpendicular to the pressing direction by the first press portion. When the process cartridge is positioned at the third predetermined position, the first and second pressed portions are not pressed by the first and second press portion.

Preferably, the pressing direction by the first and second press portions may be identical to the direction that the process cartridge is mounted on the image forming apparatus.

According to a third aspect of the present invention, there is provided an image forming apparatus, comprising:

a process cartridge comprising:

a unit comprising an element used for an image forming process;

a positioning member having a positioning member;

a holding member for holding the unit to allow displacement of the unit relative to the positioning member; and a restricting and releasing mechanism for restricting or releasing the displacement of the unit relative to the positioning member;

an image forming unit for forming an image using the element of the process cartridge; and an engagement portion which engages with the positioning member of the process cartridge to position the process cartridge at a predetermined mount position in the image forming apparatus.

According to a fourth aspect of the present invention, there is provided an image forming apparatus, comprising:

a process cartridge comprising:

a unit comprising an element used for an image forming process;

a positioning member having a first positioning member; and a first pressed portion;

an image forming unit for forming an image using the element of the process cartridge;

an engagement portion which engages with the positioning member of the process cartridge to position the process cartridge at a first predetermined position in the image forming apparatus; and a first press portion for pressing the first pressed portion of the process cartridge when the process cartridge is moved from the first predetermined position to a second predetermined position to position the process cartridge at the second predetermined position.

BRIEF DESCRIPTION OF THE DRAWINGS

Further objects and advantages of the present invention will become clear from the following description taken in conjunction with the preferred embodiments thereof with reference to the accompanying drawings, in which.

DETAILED DESCRIPTION OF THE PREFERRED EMBODIMENTS

Figure 1:
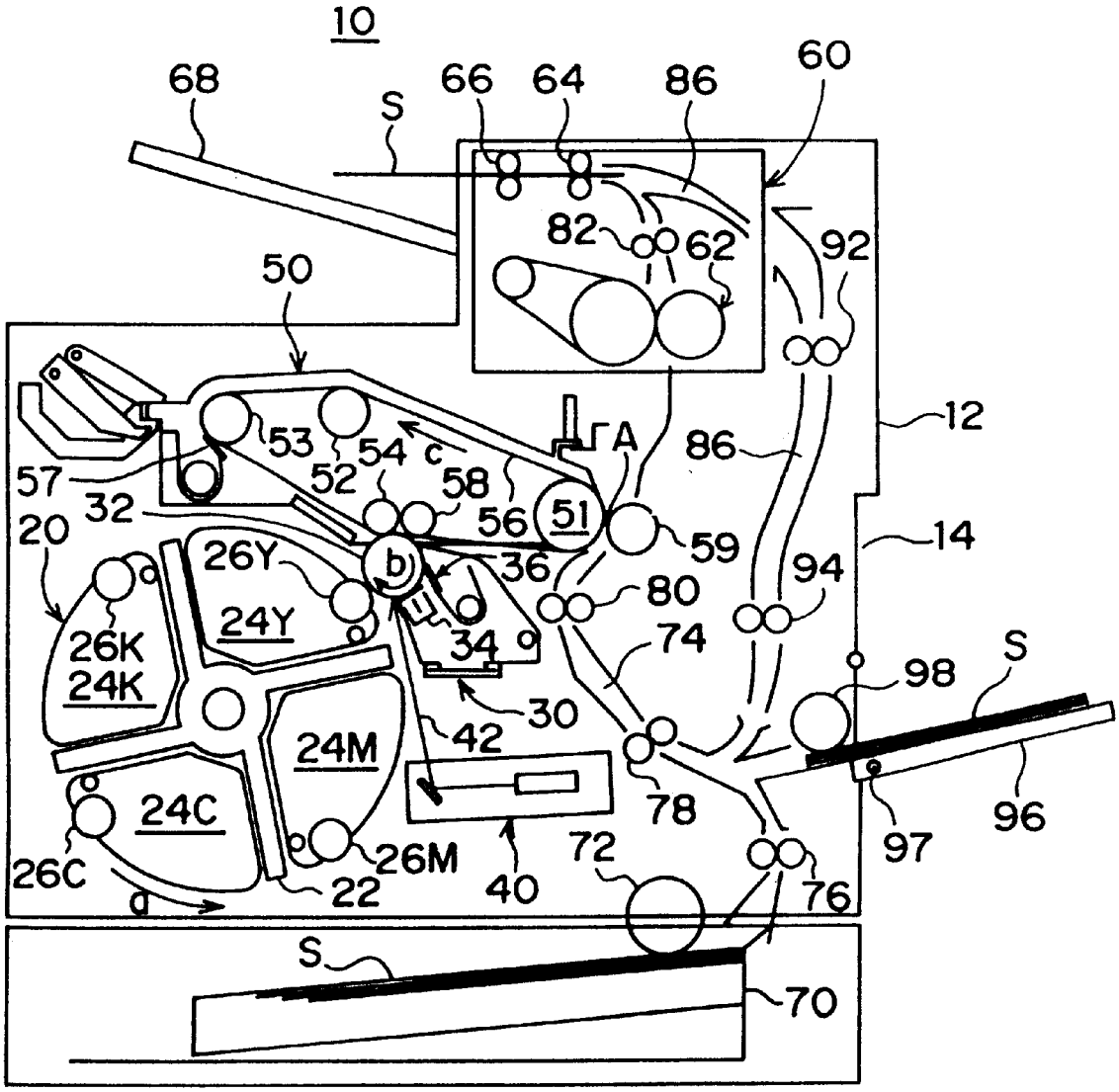
FIG. 1 is a schematic structural view of a color printer as an embodiment of an image forming apparatus.

FIG. 1 shows a general structural view of a color printer 10 according to the present invention. The color printer 10 is provided with a developing unit 20, a photosensitive unit 30, a laser print head 40, an intermediate transfer unit 50 and a fixing unit 60.

The developing unit 20 has a rotation rack 22 driven to rotate in a direction of arrow "a". On the rotation rack 22, four developing vessels 24Y, 24M, 24C and 24K are held in a juxtaposed condition in a circumferential direction. In the developing vessels 24Y, 24M, 24C and 24K are contained toners with colors of yellow, magenta, cyan and black, respectively. The developing vessels 24Y, 24M, 24C and 24K have developing rollers 26Y, 26M, 26C and 26K, respectively, which turn and convey the respective toners carried on the outer peripheries of the rollers.

The photosensitive unit 30 has a photosensitive drum 32 driven to rotate in a direction of arrow "b". The photosensitive drum 32 is arranged to oppose to the developing roller 26Y, 26M, 26C or 26K of the developing vessel 24Y, 24M, 24C or 24K which arrives at a developing position by the rotation of the rotation rack 22. In FIG. 1, the developing position is a position where the developing vessel 24Y is positioned. Around the photosensitive drum 32, there are disposed an electrostatic charger 34 for uniformly charging the surface of the photosensitive drum 32 and a cleaner 36 for removing the toner remaining on the surface of the photosensitive drum 32 after the first transfer.

The laser print head 40 irradiates a laser beam 42 on the uniformly charged surface of the photosensitive drum 32 in accordance with an image information input from the outside. Thus, on the surface of the photosensitive drum 32 are formed a latent image for each color toner image.

The intermediate transfer unit 50 has an intermediate transfer belt 56 which is supported on four rollers 51, 52, 53 and 54 and driven to rotate in a direction of arrow "c". Adjacent to the roller 54 is disposed a first transfer roller 58. In the vicinity of the first transfer roller 58, the intermediate transfer belt 56 is opposed to the photosensitive drum 32. The intermediate transfer belt 56 is also opposed to a second transfer roller 59 at a portion supported by the roller 51. A portion where the second transfer roller 59 and the intermediate transfer belt 56 are opposed to each other is an image forming portion A. On the outer surface of the intermediate transfer belt 56, a cleaner 57 for removing the toner remaining on the surface of the intermediate transfer belt 56 after the second transfer. The intermediate transfer member is not limited to a belt type but may be another type, for example, a drum type.

The fixing unit 60 has a fixing roller 62 and two pairs of discharge rollers 64, 66 which constitute a discharge portion. A sheet on which an image is fixed by passing through the fixing roller 62 is discharged on a discharge tray 68 by the rotation of the discharge rollers 64, 66. The discharge portion may comprise a pair of rollers or a pair of belts.

Under the color printer 10, a feed cassette 70 as a feed portion is disposed. The feed cassette 70 contains sheets S such as recording papers in a stacked condition. Rotation of a feed roller 72 causes the uppermost sheet S to be fed out one by one.

A sheet conveying path 74 is formed to extend in a substantially vertical direction from the feed cassette 70. The sheet conveying path 74 extends from the feed cassette 70 to the pairs of discharge rollers 64, 66 through the image forming portion A and the fixing roller 62. Rotation of conveyance roller pairs 76, 78, 80 and 82 causes the sheet S fed out of the feed cassette 70 to be upwardly conveyed along the sheet conveying path 74.

In a space between the sheet conveying path 74 and a substantially flat side wall 12 of the printer body is formed a refeed path 86, having conveyance roller pairs 92 and 94, for stopping the sheet on one side surface of which an image is formed at the image forming portion A as shown in FIG. 1, switchbacking and refeed it to the image forming portion A in a reversed state.

The upper portion of the refeed path 86 extends to the inside of the fixing unit 60 and meets with the sheet conveying path 74 in front of the pair of discharge rollers 64. The lower portion of the refeed path 86 meets with the sheet conveying path 74 in front of the conveyance roller pair 78.

Referring to FIG. 1 again, a manual feed tray 96 is attached on the outside surface of the side wall 12 of the printer body. The manual feed tray 96 is possible to pivot around a shaft 97 to open and close. With the manual feed tray 96 opened (in a state as shown in FIG. 1), the sheets S are set on the tray. Rotation of the feed roller 98 causes the uppermost one of the sheets S set on the manual feed tray 96 to be fed to the sheet conveying path 74 one by one.

AS the developing vessels 24Y, 24M, 24C and 24K are detachably mounted on the printer body, these developing vessels are referred to as toner cartridges 200 (one embodiment of the process cartridge according to the present invention).

Figure 2:
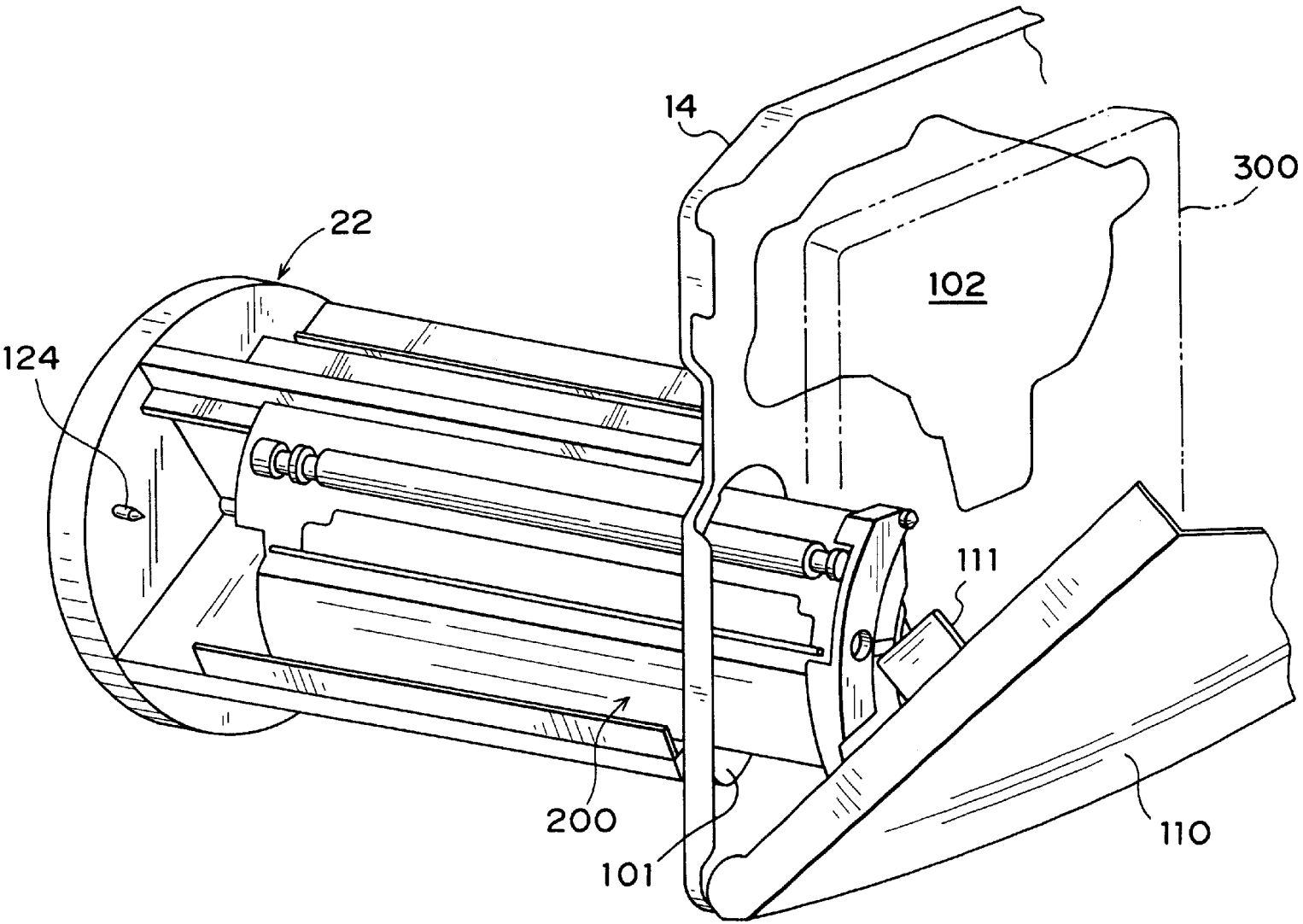
FIG. 2 is a perspective view showing a state of closing a cover of an apparatus body to mount a toner cartridge.
Figure 3:
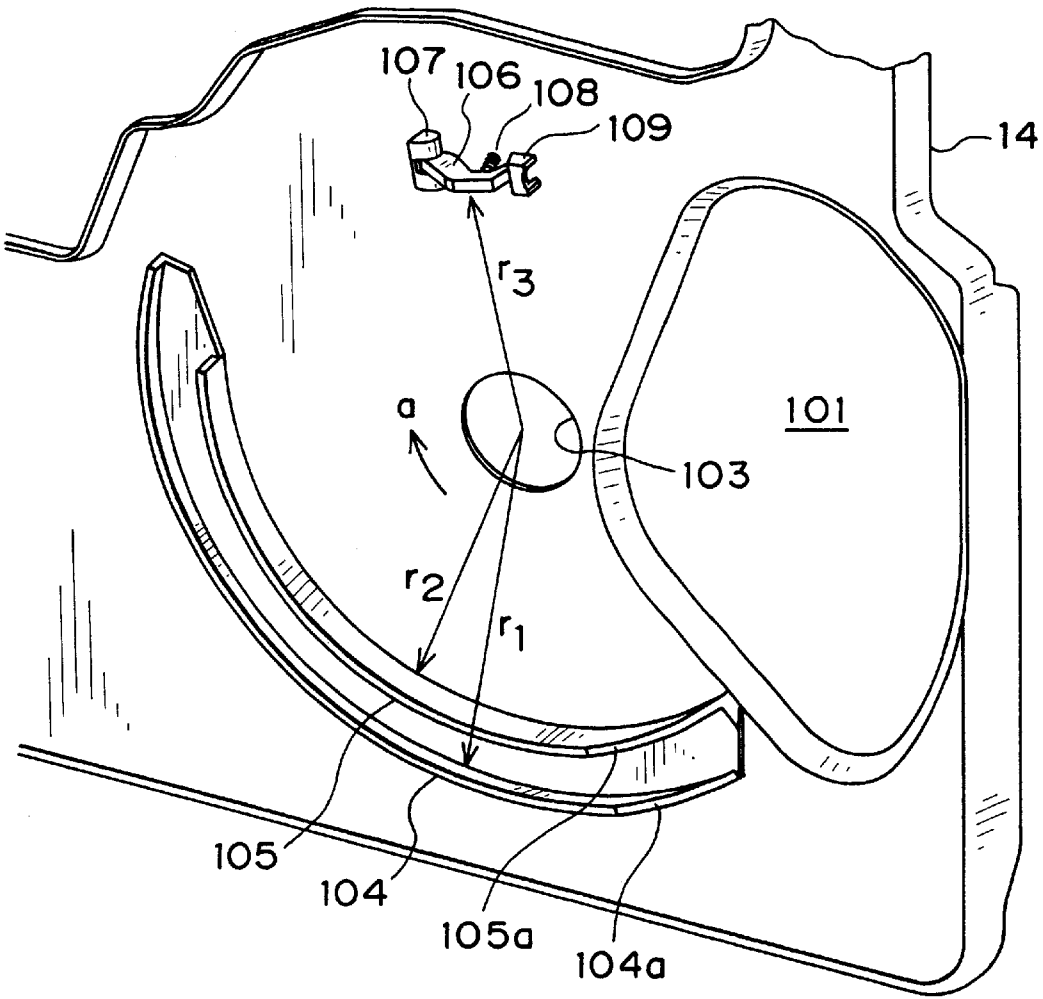
FIG. 3 is a perspective view viewed from the inside of the front wall of the apparatus body.

A structure of printer body for mounting and positioning the toner cartridge 200 on the printer body will be explained first. As shown in FIG. 2, the front wall 14 of the printer body is formed with an opening 101 for dismounting and mounting the toner cartridge 200 and an opening 102 for dismounting and mounting the photosensitive unit 30 and the intermediate transfer unit 50. On the back side surface of the front wall 14, as shown in FIG. 3, there are formed two arcuate ribs 104, 105 (corresponding to the first press portions according to the present invention) which have a center at an shaft aperture 103 for supporting the rotation rack 22 and radiuses of r1, r2 respectively. The upstream end portions of the ribs 104, 105 with respect to the rotational direction "a" of the rotation rack 22 are formed with inclined surfaces 104*a,* 105*a*. On the downstream side of the ribs 104, 105 with respect to the rotational direction "a" of the rotation rack 22, a press lever 106 (corresponding the third press portion according to the present invention) is pivotably attached by a shaft 107 at a position apart from the shaft aperture 103 of the rotation rack 22 with a radius of r3 (r1>r2>r3). The press lever 106 is urged by a spring 108 toward the inside from the front wall 14 so that the end of the lever 106 comes into contact with a reverse U-shape of stopper 109. Outside of the front wall 14 of the printer body is provided with a cover 110 for covering the openings 101, 102. Inside the cover 110 is provided with a projection 111 (corresponding to the second press portion according to the present invention) for pressing the toner cartridge 200 inserted into the opening 101 when closing the cover 110.

Figure 4:
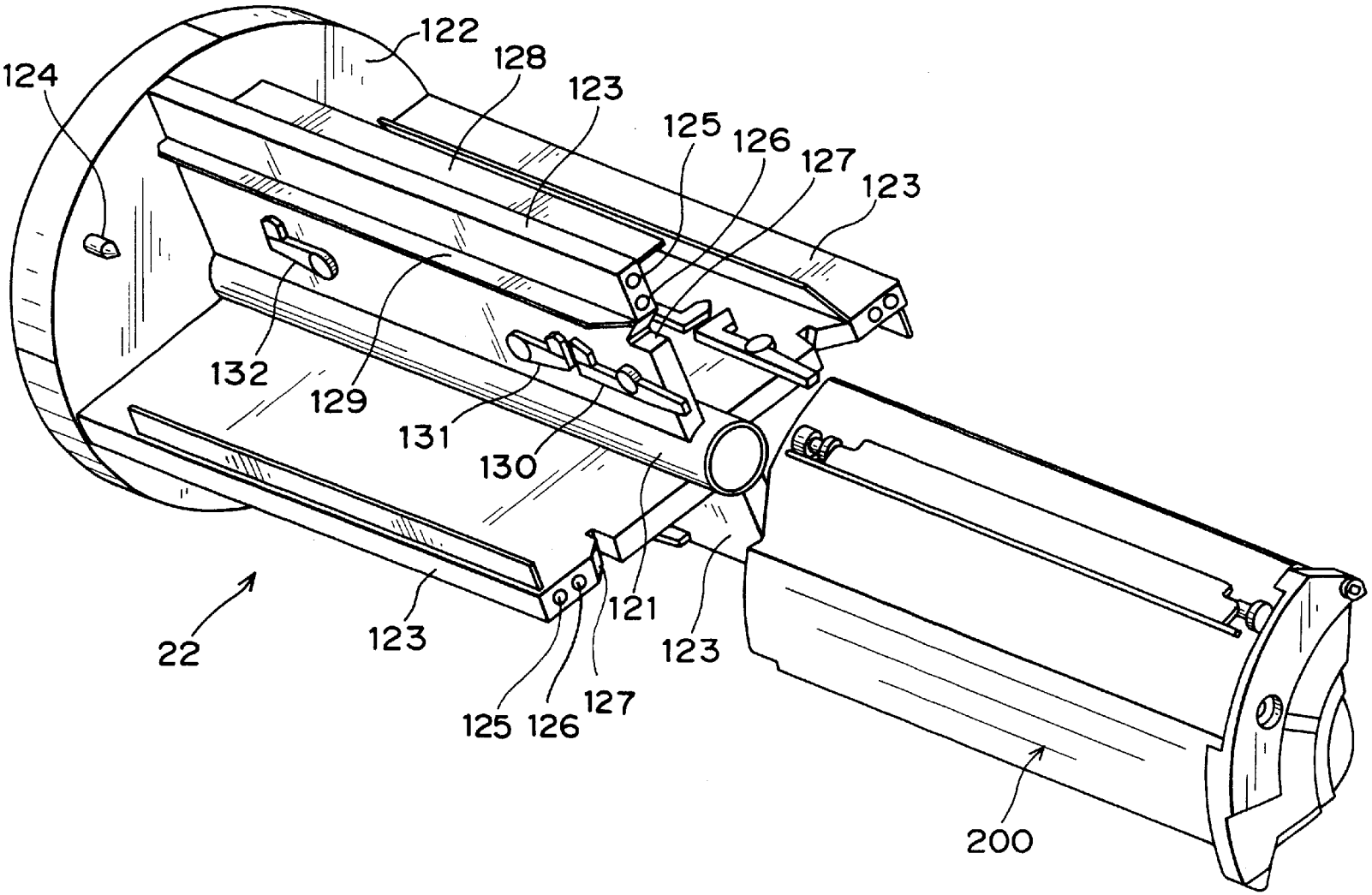
FIG. 4 is a perspective view of a rotation rack and the toner cartridge.

The rotation rack 22 comprises as shown in FIG. 4 a rotation shaft 121, a circular end plate 122 positioned at an end of the rotation shaft 121 and four wing plates 123 disposed around the rotation shaft 121 which are integrally formed as an integral part. The rotation rack 22 is possible to be rotated around the rotation shaft 121. On an area of the end plate 122 surrounded by two wing plates 123 is formed with a pivot shaft portion 124 comprising a pin which projects parallel to the rotation shaft 121. On the end surface of each wing plate 123, there are formed a first positioning recess 125, a second positioning recess 126 and a V-shaped cutout 127 in order from the outside to the inside. The first positioning recess 125 of one first wing plate 123 and the second positioning recess 126 of the other wing plate 123 adjacent to the one first wing plate 123 constitute a positioning member of the toner cartridge 200 to be inserted therebetween.

Figure 13A:
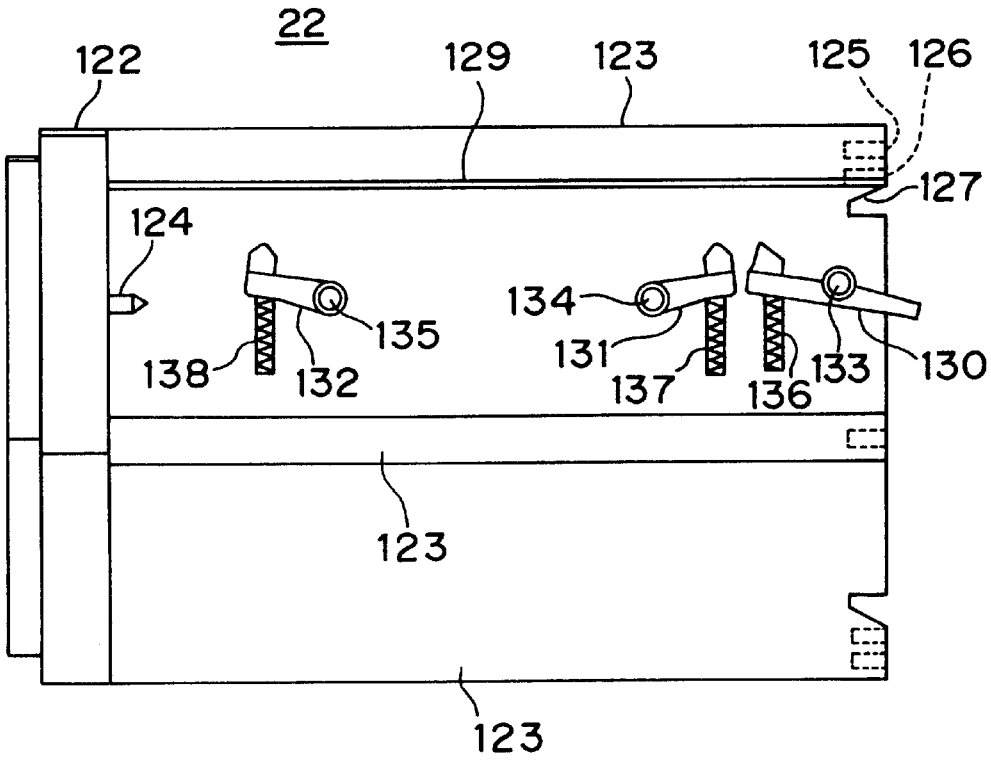
FIG. 13A is a side view of the rotation rack showing a state before mounting the toner cartridge.

On the edge of one side surface of each wing plate 123 is formed a first guide ridge 128 which extends parallel to the rotation shaft 121. On the other side surface is formed a second guide ridge 129 which is disposed more inside than the first guide ridge 128 and extends parallel to the rotation shaft 121 in the same manner as the first guide ridge 128. The first guide ridge 128 of one first wing plate 123 and the second guide ridge 129 of the other wing plate 123 adjacent to the one first wing plate 123 constitute a guide portion of the toner cartridge 200 to be inserted therebetween. Inside the second guide ridge 129 of each wing plate 123 are provided a positioning lever 130, a first press lever 131 and a second press lever 132 which are possible to pivot around a shafts 133, 134 and 135 respectively and urged toward the second guide ridge 129 by means of springs 136, 137 and 138 as shown in FIG. 13A.

Figure 5:
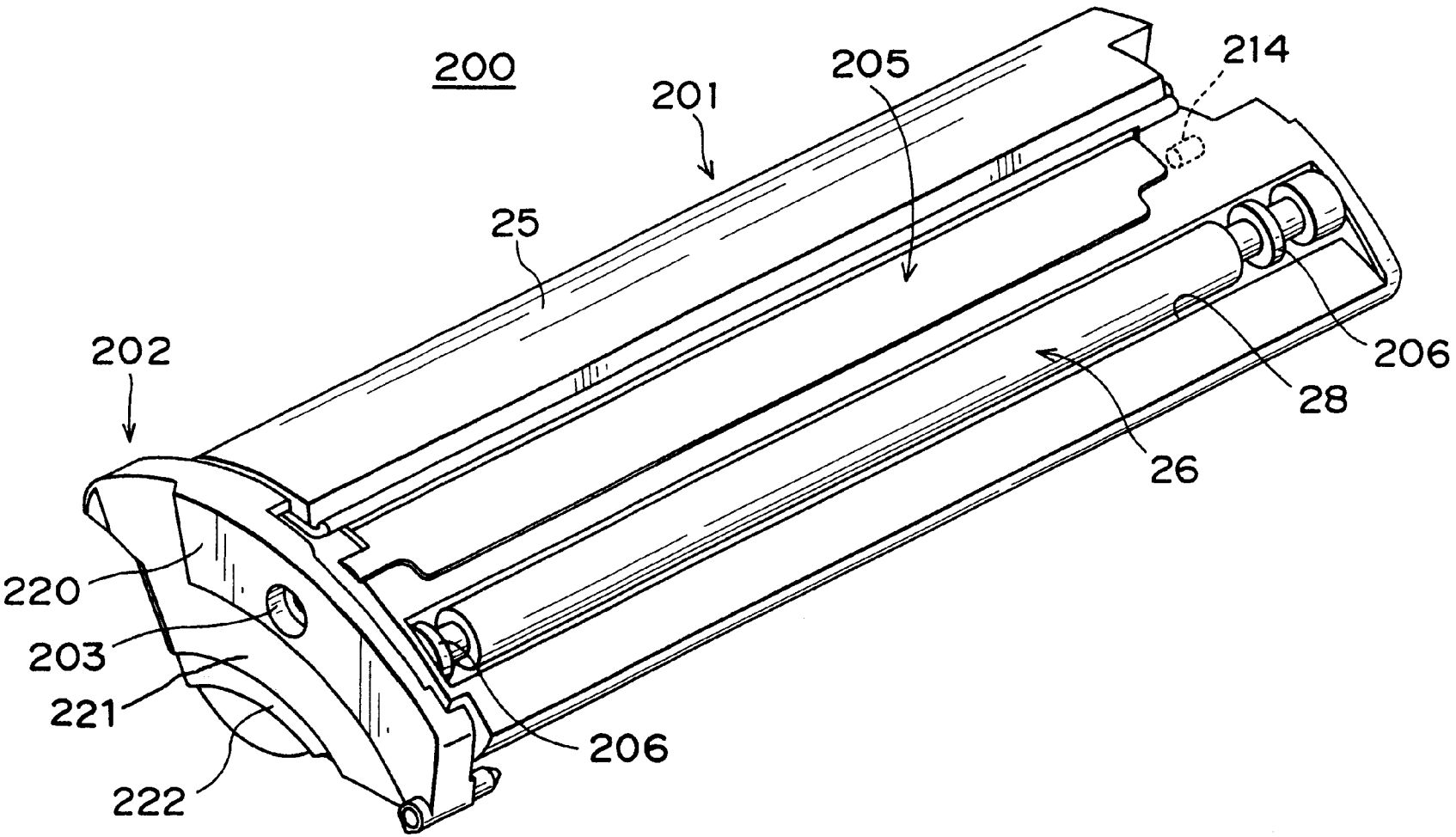
FIG. 5 is a perspective view of the toner cartridge.

Consequently, construction of the toner cartridge 200 itself will be explained. As shown in FIG. 5, the toner cartridge 200 comprises a unit member 201, a positioning member 202, a holding portion 203, a restricting and releasing mechanism 204 and a protection cover 205.

Figure 6:
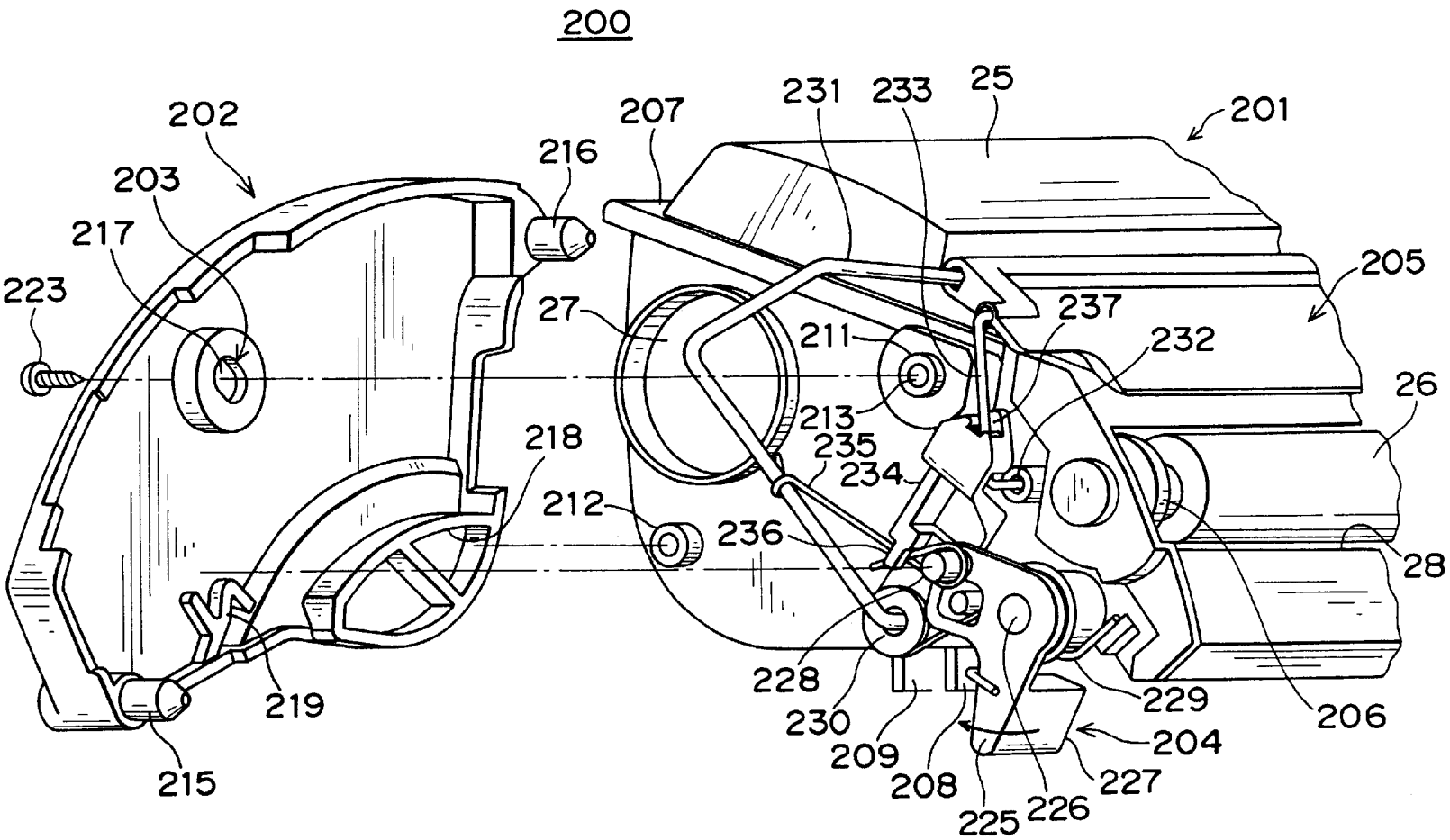
FIG. 6 is a perspective view of the toner cartridge with a positioning member removed.

The unit member 201 has as shown in FIG. 6 a toner container 25 and a developing roller 26 as elements necessary to the image forming process. The toner container 25 has an elongated shape and contains toner of predetermined color. The toner can be replenished through a replenishment port 27 formed on the one end of the toner container 25. The developing roller 26 is rotatably provided so that a part thereof can be revealed from an opening 28 of the toner container 25, whereby the toner is carried on the outer surface of the developing roller 26. On both ends of the developing roller 26 are provided runners 206. The runners 206 come into press contact with the photosensitive drum 32 at the developing position so that a gap between the developing roller 26 and the photosensitive drum 32 can be precisely maintained to keep high image quality.

Figure 12:
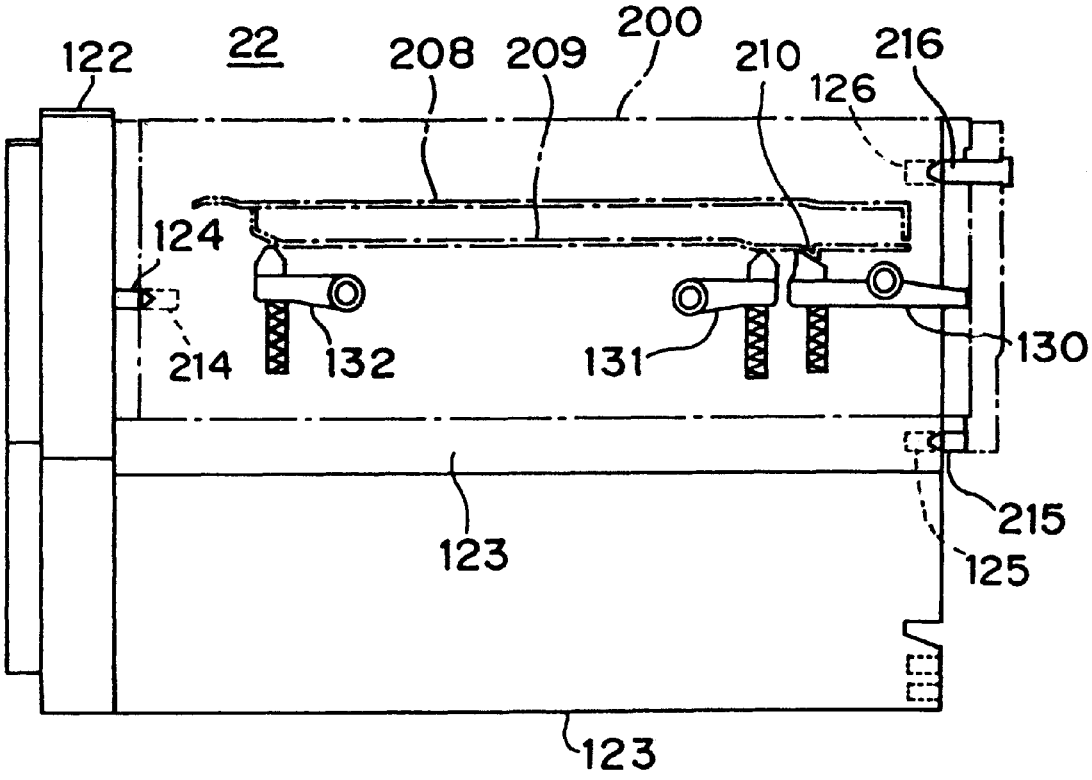
FIG. 12 is a schematic side view showing a first positioning state of the toner cartridge.

On the outer surface of the toner container 25 are formed a guide surface 207 and a guide ridge 208 which cooperate with the first and second guide ridges 128, 129 of the aforementioned rotation rack 22 respectively. On the outer surface of the toner container 25 are also formed a press ridge 209 parallel to the guide ridge 208. To the press ridge 209 comes into pressure contact with the first and second press lever 131 and 132 of the rotation rack 22. The press ridge 209 is as shown in FIG. 12 formed with an engagement portion 210 with which the positioning lever 130 of the rotation rack 22 engages.

On one end surface of the toner container 25 on which the replenishment port 27 is positioned, a pivot shaft portion 211 and a pivot range restricting projection 212 are formed. The pivot shaft portion 211 constitutes the holding portion 203. The pivot range restricting projection 212 restricts pivot of the unit member 201 with respect to the positioning member 202. The pivot shaft portion 211 is formed with a screw hole 213. On the other end surface of the toner container 25 on which the replenishment port 27 is not positioned, as shown in FIG. 5, a shaft hole 214 is formed at a position corresponding to the pivot shaft portion 211. The shaft hole 214 is arranged so as to engage with the pivot shaft portion 124 of the end plate 122 of the rotation rack 22.

The positioning member 202 has a substantially plate-like shape and covers the end portion of the toner container 25 on which the replenishment port 27 is positioned. On the inside surface of both ends of the positioning member 202, there are formed first and second positioning projections 215 and 216 extending to the longitudinal direction of the toner container 25. The first and second positioning projections 215, 216 (corresponding to the positioning member of the present invention) are arranged to engage with the first and second positioning recesses 125, 126. On the center of the positioning member 202, there is formed a holding aperture 217 at a position corresponding to the pivot shaft portion 211 of the toner container 25. On the inside surface of the positioning member 202, a segment shape of pivot range restricting rib 218 and a V shape of restriction rib 219 are formed. The pivot range restricting rib 218 is arranged so that the pivot range restricting projection 212 of the toner container 25 can enter into the pivot range restricting rib 218. The restriction rib 219 is arranged so that a restricting and releasing pin 228 explained hereinafter of the restricting and releasing mechanism 204 can engage with the restriction rib 219. On the other hand, on the outer surface of the positioning member 202, as shown in FIG. 5, there are formed a first step portion 220, a second step portion 221 and a third step portion 222 (corresponding to first, second and third pressed portions according to the present invention). The first step portion 220 has a segment shape with a predetermined width and is located at a position most departing from the center of the rotation shaft 121 of the rotation rack 22 by a radius of r1. The second step portion 221 has a segment shape with a predetermined width and is located inside the first step portion 220 at a position departing from the center of the rotation shaft 121 of the rotation rack 22 by a radius of r2. The third step portion 222 has a segment shape with a predetermined width and is located inside the second step portion 221 at a position departing from the center of the rotation shaft 121 of the rotation rack 22 by a radius of r3.

The holding portion 203 comprises the pivot shaft portion 211 of the toner container 25 and the holding aperture 217 of the positioning member 202 into which the pivot shaft portion 211 is fitted. The holding portion 203 is arranged to pivotably hold the unit member 201 with respect to the positioning member 202. A screw 223 is screwed into the screw hole 213 of the pivot shaft portion 211 through the holding aperture 217, preventing the positioning member 202 from coming away from the unit member 201. The pivot range restricting projection 212 of the toner container 25 enters into pivot range restricting rib 218 of the positioning member 202, restricting the pivot of the unit member 201 within a predetermined pivot range.

The restricting and releasing mechanism 204 comprises a restricting and releasing lever 225 provided on the toner container 25 and a restriction rib 219 formed on the positioning member 202. The restricting and releasing lever 225 is arranged to pivot around a shaft 226 on the end portion of the toner container 25 on which the replenishment port 27 is formed. On one end of the restricting and releasing lever 225 is formed a projection 227 projecting in a direction coming away from the positioning member 202. On the other end of the restricting and releasing lever 225 is formed a restricting and releasing pin 228 projecting toward the positioning member 202. The restricting and releasing lever 225 is urged by a spring 229 in a direction that the restricting and releasing pin 228 engages with the restriction rib 219 of the positioning member 202. The projection 227 of the restricting and releasing lever 225 is so arranged that the projection 227 comes into contact with the cutout 127 of the wing plate 123 of the rotation rack 22 when mounting the toner cartridge 200 to rotate the restricting and releasing lever 225 around the shaft 226 in a direction of an arrow, disengaging the restricting and releasing pin 228 from the restriction rib 219.

The protection cover 205 has a plate-like shape which covers the developing roller 26 of the unit member 201. The protection cover 205 has first wire levers 231 and a second wire lever 233. The first wire levers 231 extend from the both ends of the protection cover 205 and are fitted into shaft holes 230 formed on the both ends of the toner container 25. The second wire lever 233 extends form the end of the protection cover 205 on a side which the replenishment port 27 of the toner container 25 is formed and is fitted into a shaft hole 232 formed on the end of the toner container 25. Thus, the protection cover 205 is possible to substantially translate between a cover position where the protection cover 205 covers the developing roller 26 and a retreat position where the protection cover 205 retreats from the developing roller 26 to expose the latter.

The translation of the protection cover 205 is interlocked with the pivot of the restricting and releasing lever 225 via an interlocking mechanism. The interlocking mechanism comprises a link lever 234 and a link wire 235. The link lever 234 is attached coaxially with the shaft hole 230 of the first wire lever 231. One end of the link wire 235 is curled around the first wire lever 231, while the other end of the link wire 235 curled around a restricting and releasing pin 228 of the restricting and releasing lever 225. On the shaft side of the link lever 234 is formed an engaging portion 236 with which the link wire 235 engages, while on the tip end side of the link lever 234 is formed a through hole 237 into which the second wire lever 233 is inserted.

Figure 7:
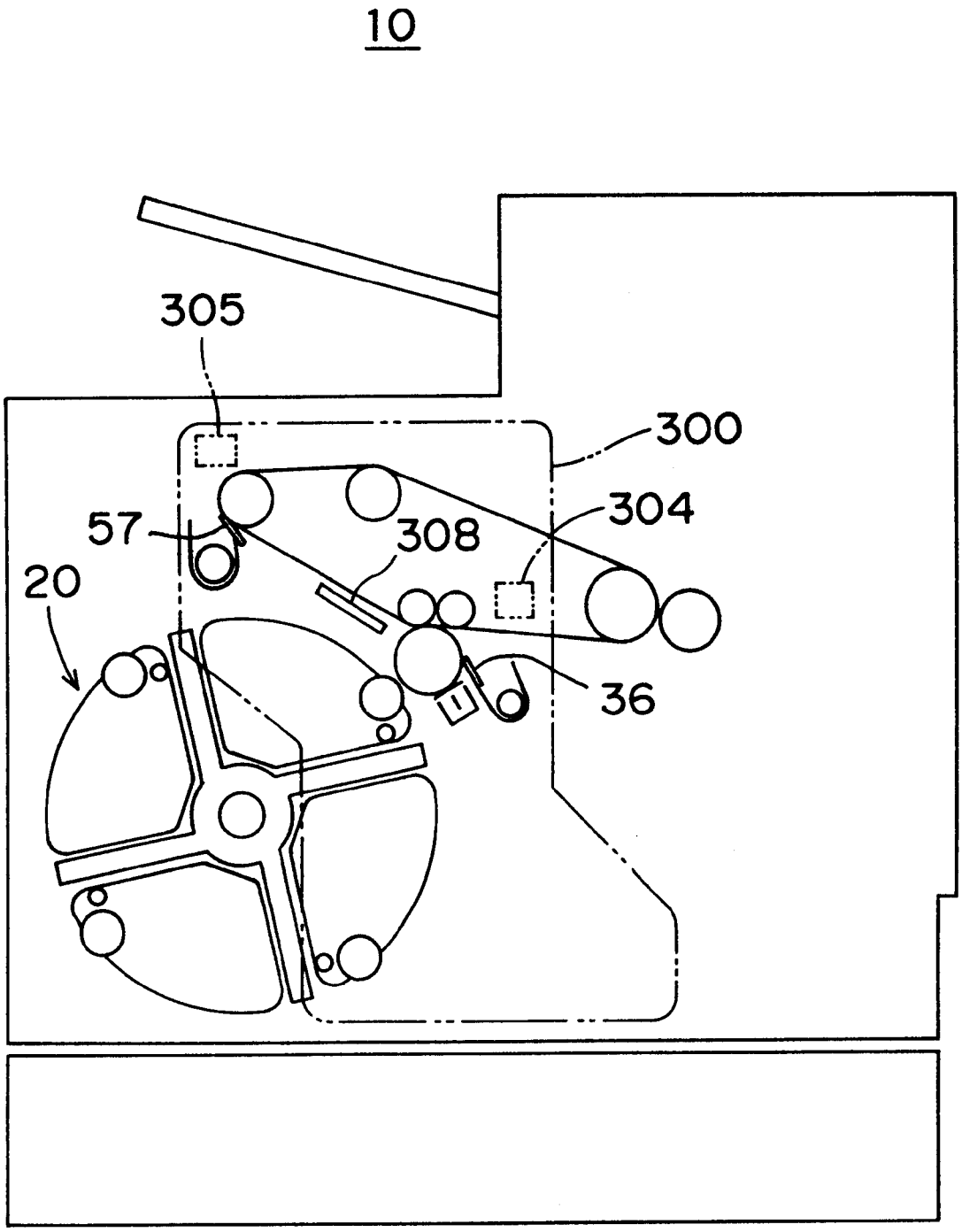
FIG. 7 is a front view of the color printer with a toner recovery box mounted.
Figure 8:
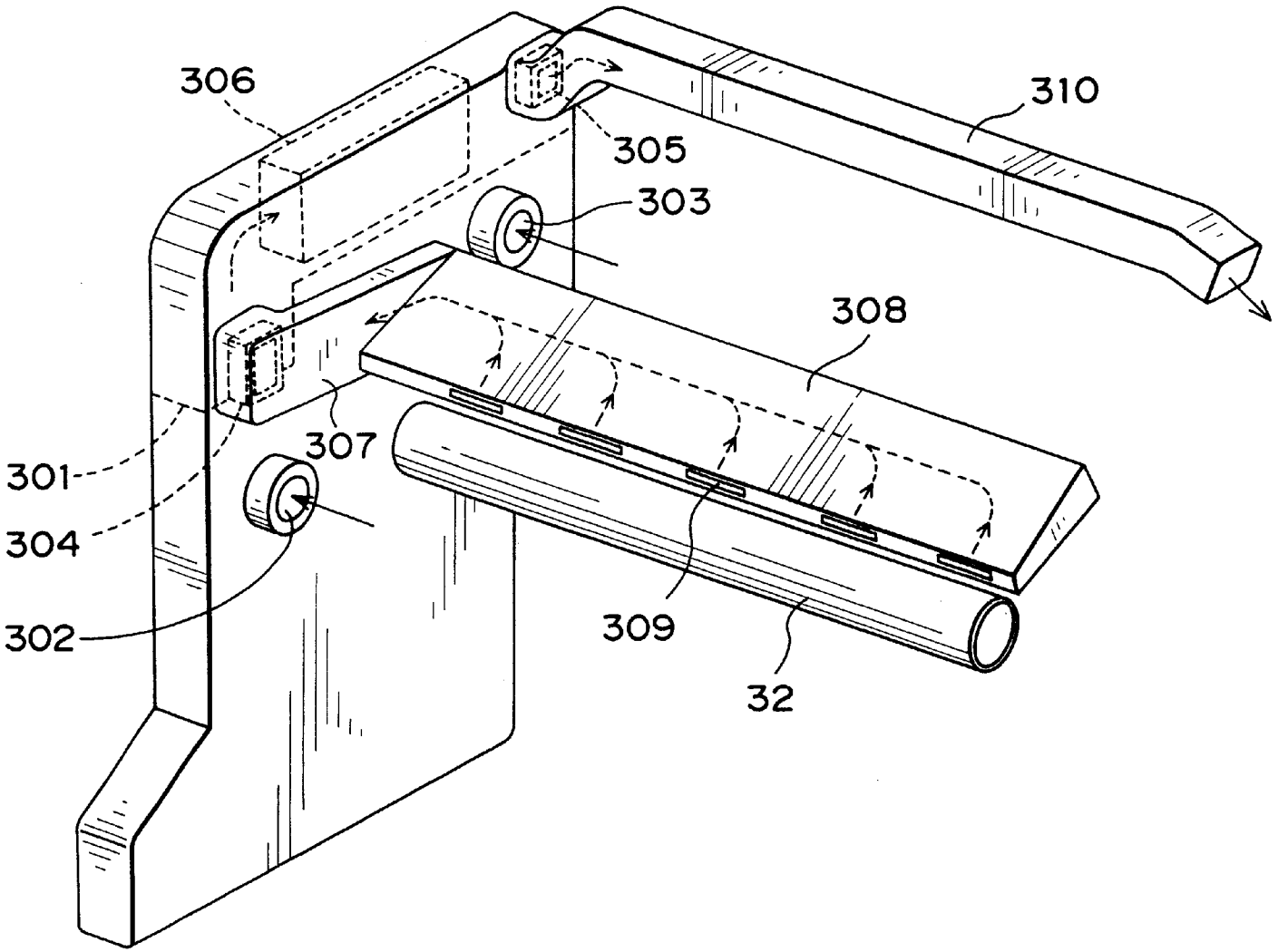
FIG. 8 is a perspective view of the toner recovery box.

By the way, as shown in FIG. 2, in the present embodiment of the color printer 10 a toner recovery box 300 is provided between the front wall 14 and the cover 110. The toner recovery box 300, as shown in FIGS. 7, 8, has a substantially rectangular shape and is partitioned by a partition wall 301 into an upper part and a lower part. The lower part of the toner recovery box 300 has a first receiving port 302 for receiving the remaining toner conveyed by an unshown conveyor screw after being removed by the cleaner 36 of the photosensitive drum 32 and a second receiving port 303 for receiving the remaining toner conveyed by an unshown conveyor screw after being removed by the cleaner 57 of the intermediate transfer belt 56. The upper part of the toner recovery box 300 has a smoke toner inlet port 304 and a discharge port 305, between which a filter 306 is filled in. The smoke toner inlet port 304 is connected to a suction box 308 via a suction duct 307. The suction box 308 has an elongated rectangular shape so that it is disposed along the photosensitive drum 32. The suction box 308 is formed with a plurality of suction port 309 on the surface opposing to the photosensitive drum 32. The discharge port 305 is connected to a fan provided on an unshown rear wall via a discharge duct 310.

Thus, the remaining toner removed by both the cleaner 36 of the photosensitive drum 32 and the cleaner 57 of the intermediate transfer belt 56 is recovered into the lower part of the toner recovery box 300. The smoke toner generating at a developing region is conveyed by the suction air stream in a direction of an arrow caused by the rotation of the fan to enter into the upper part of the toner recovery box 300 and then collected and recovered by the filter 306. Thus, both the recovery of the remaining toner on the photosensitive drum 32 and the intermediate transfer belt 56 and the recovery of the smoke toner at the developing region are carried out in the same toner recovery box 300, simplifying the recovery work. In addition, the smoke toner at the developing region is removed by the suction air stream, reducing an image failure such as fogging.

Hereinafter, mounting and dismounting operations of the toner cartridge 200 in the color printer 10 having a above described construction will be explained.

Figure 9:
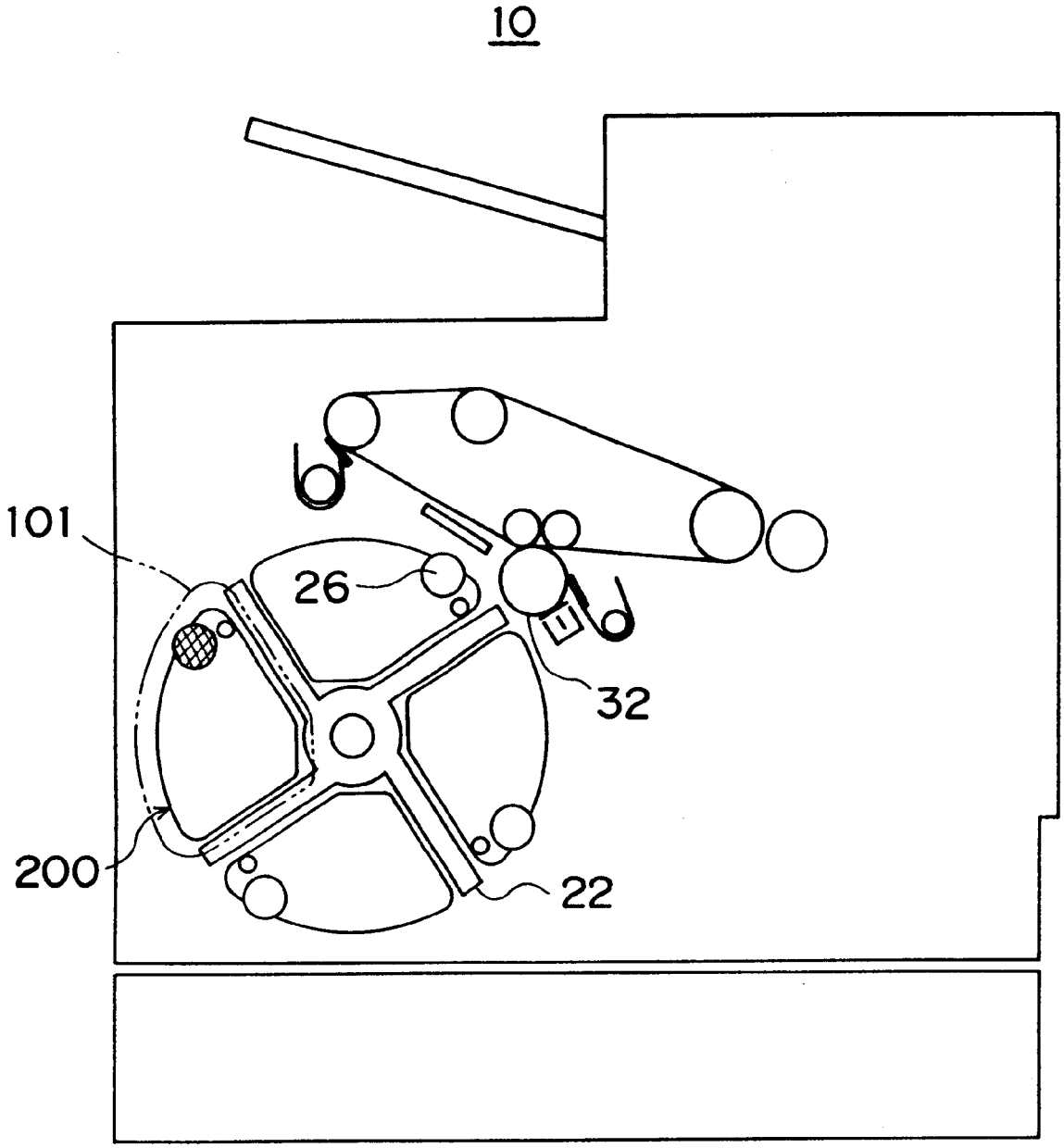
FIG. 9 is a front view showing a relation between the toner cartridge and an opening portion.
Figure 10:
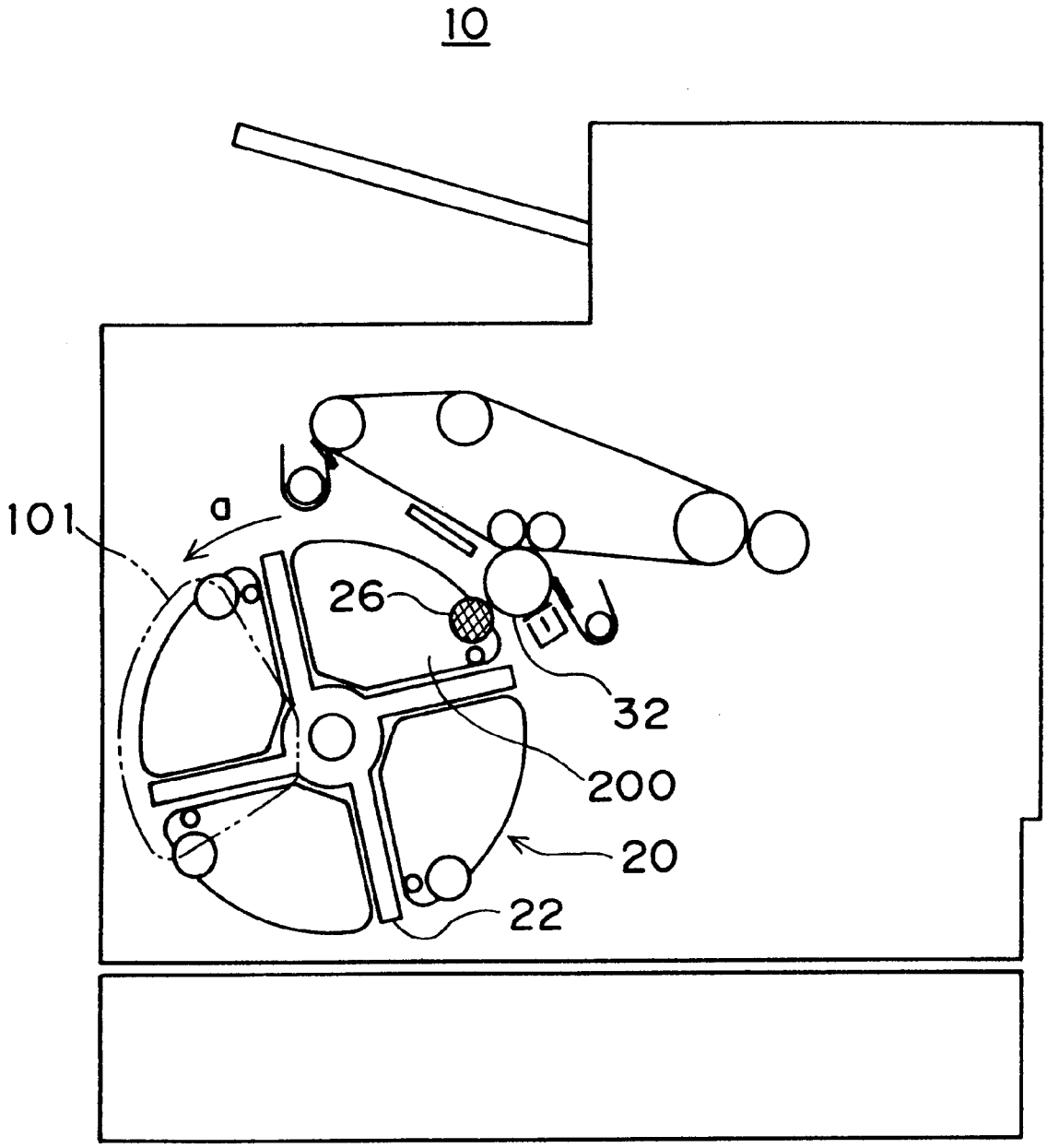
FIG. 10 is a front view showing a relation between the toner cartridge and the opening portion.

In FIG. 9, when the developing roller 26 crosshatched is positioned at the developing position, the toner cartridge 200 is offset from the opening 101 so that the toner cartridge 200 can not be dismounted. This prevents the runners 206 of the developing roller 26 positioned at the developing position from being damaged due to vibration and impact when mounting and dismounting the toner cartridge 200 and prevents the photosensitive drum 32 from being damaged by the runners 206. For example, in order to remove the toner cartridge 200 having the crosshatched developing roller 26 for the purpose of toner replenishment, repair or the like, the cover 110 is opened and the rotation rack 22 is rotated in a direction of an arrow by an unshown handle to position the toner cartridge 200 at the opening 101 as shown in FIG. 10. At this time, the developing roller 26 of the other toner cartridge 200 is shifted from the photosensitive drum 32 and therefore never comes into contact with the latter. Thus, the toner cartridge 200 concerned can be safely dismounted. The toner cartridge 200 can be dismounted by pulling out the toner cartridge 200 in an axial direction of the rotation rack 22 after protruding a part of the toner cartridge 200 by an unshown pulling out mechanism.

When the toner cartridge 200 is pulling out, the projection 227 of the restricting and releasing lever 225 as shown in FIG. 6 disengages from the cutout of the wing plate 123 of the rotation rack 22, whereby the restricting and releasing lever 225 pivots in a reverse-clockwise direction in FIG. 6 by the urging force of the spring 229. As a result, the first wire lever 231 and the second wire lever 233 pivot in a clockwise direction in FIG. 6 via the link lever 234 and the link wire 235 so that the protection cover 205 moves to the cover position. Thus, the developing roller 26 is protected, preventing hands or clothes of an operator from being fouled with the toner carried on the developing roller 26. Pivot of the restricting and releasing lever 225 in a reverse-clockwise direction in FIG. 6 causes the restricting and releasing pin 228 to engage with the restriction rib 219 of the positioning member 202, restricting the pivot of the positioning member 202 around the holding portion 203. Thus, the toner cartridge 200 after being removed becomes a state that the unit member 201 and the positioning member 202 are secured to each other, preventing the positioning member from becoming loose.

Figure 11A:
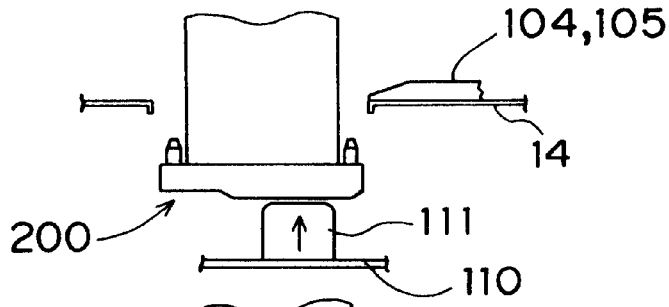
FIGS. 11A–11E are schematic plan views sequentially showing states when mounting the toner cartridge.
Figure 11B:
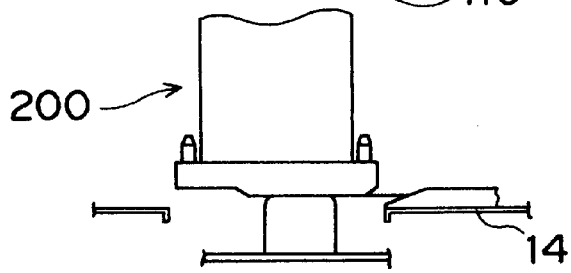

Next, in order to mount the toner cartridge 200 with the toner replenished, the toner cartridge 200 repaired or a new toner cartridge 200, the cover 110 is opened and the rotation rack 22 is rotated by the unshown handle to position a blank storing portion of the rotation rack 22 at the opening 101. Consequently, as shown in FIG. 2, with the positioning member 202 directed to this side, the end of the unit member 201 is inserted into the opening 101. At this time, the guide surface 207 and the guide ridge 208 of the unit member 201 are guided by the first and second guide ridges 128, 129 respectively, whereby the unit member 201 is smoothly surely housed into the rotation rack 22. Even if the toner cartridge 200 is in a half-inserted state, closure of the cover 110 as shown in FIG. 2 allows the projection 111 of the cover 110 to push the outer surface of the positioning member 202 of the toner cartridge 200, causing the toner cartridge 200 to be inserted into the rotation rack 22 (refer to FIGS. 11A, 11B).

Thus, the toner cartridge 200 inserted into the rotation rack 22 is in a first positioned state (corresponding to the first predetermined position of the present invention) as shown in FIG. 12. In the first positioned state, into the shaft hole 214 of the unit member 201 is slightly fit the pivot shaft portion 124 of the rotation rack 22, while the first and second positioning projections 215 and 216 of the positioning member 202 are slightly fit into the first and second positioning recesses 125, 126 of the rotation rack 22. The positioning lever 130 of the rotation rack 22 is not engaged with the engagement portion 210 of the toner cartridge 200 yet. As described above, as the pivot of the positioning member 202 around the holding portion 203 is restricted so that the unit member 201 and the positioning member 202 are secured to each other, the first and second positioning projections 215 and 216 of the positioning member 202 of the toner cartridge 200 can be surely inserted into the first and second positioning recesses 125, 126 of the rotation rack 22 without deviating.

At the time when the toner cartridge 200 is inserted in the first positioned state, the projection 227 of the restricting and releasing lever 225 as shown in FIG. 6 comes into contact with the inclined surface of the cutout 127 of the wing plate 123 of the rotation rack 22 and is pushed, whereby the restricting and releasing lever 225 pivots against the urging force of the spring 229. As a result, the first and second wire levers 231, 233 pivot via the link lever 234 and the link wire 235, causing the protection cover 205 to move to the retreat position. Thus, the developing roller 26 is exposed as shown in FIG. 6.

Pivot of the restricting and releasing lever 225 causes the restricting and releasing pin 228 to disengage from the restriction rib 219 of the positioning member 202, whereby pivot of the positioning member 202 around the holding portion 203 is released. Thus, the unit member 201 of the toner cartridge 200 is possible to pivot around a fulcrum defined by the holding aperture 217 of the positioning member 202 and the pivot shaft portion 124 of the rotation rack 22. At this time, the pivot range restricting projection 212 of the unit member 201 comes into contact with the pivot range restricting rib 218 of the positioning member 202, whereby the pivot range of the unit member 201 is restricted to an extent of ±30°.

Figure 11C:
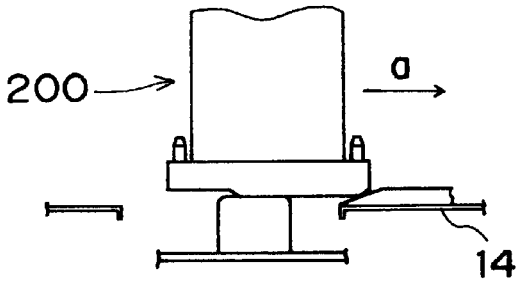
Figure 11D:
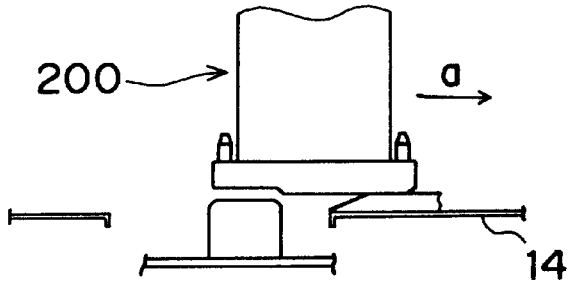

From the first positioned state, when the rotation rack 22 is rotated by the unshown handle in the direction of the arrow, the first and second step portions 220, 221 of the positioning member 202 of the toner cartridge 200 are stepwise pushed by the ribs 104, 105 of the front wall 14. As a result, the toner cartridge 200 can be further pushed in the axial direction of the rotation rack 22 (refer to FIGS. 11C, 11*d*), being in a second positioned state (corresponding to the second predetermined position of the present invention). In the second positioned state, the positioning lever 130 of the rotation rack 22 is not engaged with the engagement portion 210 of the toner cartridge 200 yet.

Figure 11E:
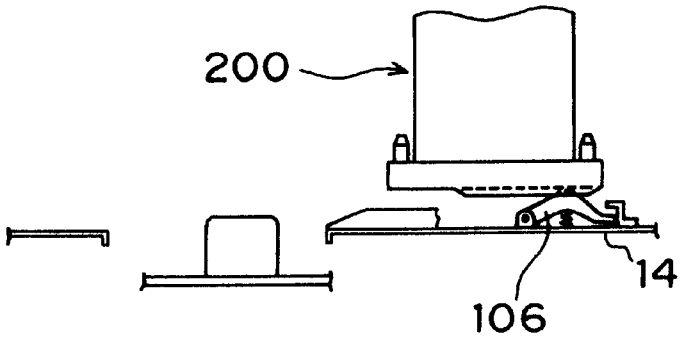
Figure 13B:
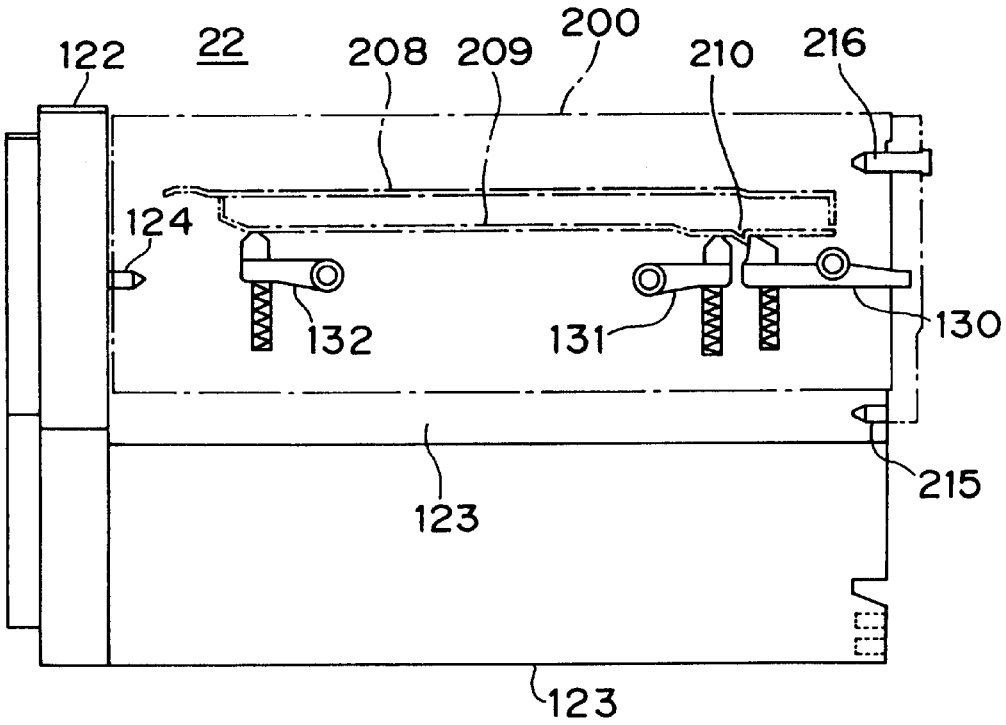
FIG. 13B is a schematic side view showing a final positioning state of the toner cartridge.

From the second positioned state, when the rotation rack 22 is rotated in the direction of the arrow, the second step portion 221 (alternatively, the third step portion 222) of the positioning member 202 of the toner cartridge 200 is pushed by the lever 106 of the front wall 14. As a result, the toner cartridge 200 can be further pushed in the axial direction of the rotation rack 22 (refer to FIG. 11E), being in a final positioned state (corresponding to the third predetermined position of the present invention). In this final positioned state, as shown in FIGS. 12 to 13B, to the shaft hole 214 of the unit member 201 of the toner cartridge 200 is perfectly fit the pivot shaft portion 124 of the rotation rack 22, while the first and second positioning projections 215 and 216 of the positioning member 202 are perfectly fit into the first and second positioning recesses 125, 126 of the rotation rack 22. The positioning lever 130 of the rotation rack 22 engages with the engagement portion 210 of the toner cartridge 200, preventing the toner cartridge 200 from coming away from the rotation rack 22.

Figure 14:
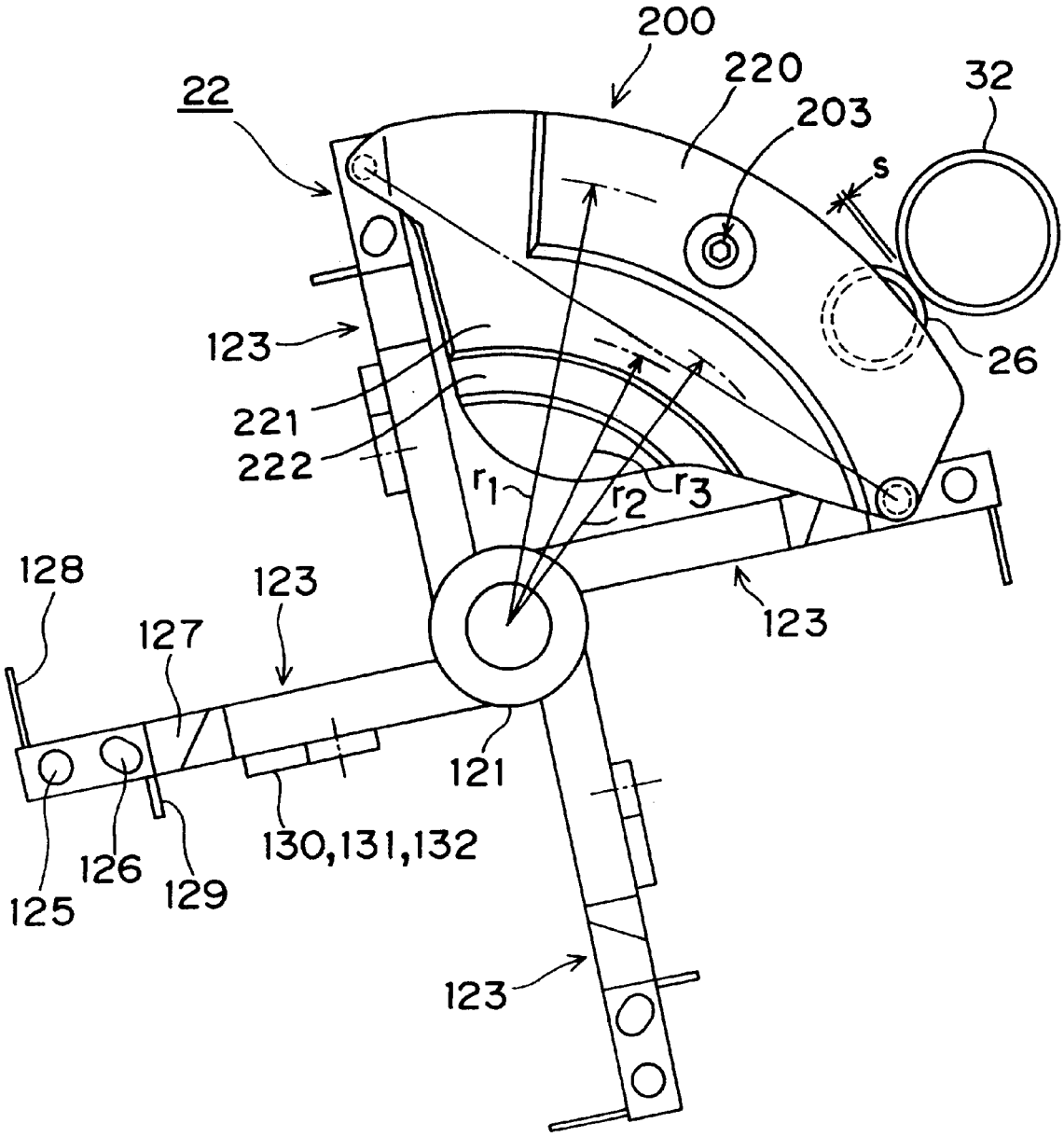
FIG. 14 is a schematic front view showing the final positioning state of the toner cartridge.

In this final positioned state, as the positioning member 202 of the toner cartridge 200 comes away from the ribs 104, 105 of the front wall 14, rotation of the rotation rack 22 is not obstructed. In addition, in the final positioned state, the positioning lever 130 and the first and second press levers 131, 132 press the press ridge 209 of the unit member 201 of the toner cartridge 200 due to the urging forces of the springs 136, 137 and 138. As a result, the unit member 201 which is pivotable around the holding portion 203 is urged as shown in FIG. 14 in the rotation direction as shown by the arrow around the holding portion 203. Thus, when the developing roller 26 of the toner cartridge 200 reaches developing position opposing to the photosensitive drum 32, the runners 26 of the developing roller 26 come into contact with the photosensitive drum 32, causing the toner cartridge 200 to be pressed down against the urging forces of the springs 136, 137 and 138. As a result, press contacts between the photosensitive drum 32 and the runners 206 are generated, whereby a gap s between the developing roller 26 and the photosensitive drum 32 is highly accurately maintained, resulting in high image quality.

In the aforementioned embodiment, the toner cartridge 200 of the developing unit 20 has been described as the process cartridge of the present invention. However, the present invention is not limited to this and may be applied to the photosensitive unit 30, the intermediate transfer unit 50 and the fixing unit 60. The present invention can be also applied to cartridges of charging, transferring, cleaning, fixing, exposing, erasing or other exchangeable members.

In the aforementioned embodiment, the color printer has been described as an example but the present invention can be applied to a monochrome printer. The present application is not limited to the printer but can be also applied to other image forming apparatuses such as a copying machine, a facsimile, a composite machine thereof and a printing machine. The present invention is not limited to the electrophotographic type of image forming apparatus but can be applied to a direct recording type, an electrostatic recording type and an ink jet type of image forming apparatuses.

Although the present invention has been fully described by way of the examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A process cartridge which can be mounted on and dismounted from an image forming apparatus, the process cartridge comprising:

a unit comprising an element used for an image forming process;

a positioning member having a positioning portion which engages with an engagement portion formed on the image forming apparatus to position the process cartridge at a predetermined mount position in the image forming apparatus;

a holding member for holding the unit to allow displacement of the unit relative to the positioning member; and a restricting and releasing mechanism for restricting or releasing the displacement of the unit relative to the positioning member, wherein the engagement portion of the image forming apparatus comprises a recess or projection, and wherein the positioning portion comprises a projection or recess which engages with the recess or projection of the engagement portion, and the projection or recess of the positioning member comprises a plurality of projections or recesses which are disposed around the holding member.

2. A process cartridge which can be mounted on and dismounted from an image forming apparatus, the process cartridge comprising:

a unit comprising an element used for an image forming process;

a positioning member having a positioning portion which engages with an engagement portion formed on the image forming apparatus to position the process cartridge at a predetermined mount position in the image forming apparatus;

a holding member for holding the unit to allow displacement of the unit relative to the positioning member; and a restricting and releasing mechanism for restricting or releasing the displacement of the unit relative to the positioning member, wherein the holding member comprises a screw member.

3. A process cartridge which can be mounted on and dismounted from an image forming apparatus, the process cartridge comprising:

a unit comprising an element used for an image forming process;

a positioning member having a positioning portion which engages with an engagement portion formed on the image forming apparatus to position the process cartridge at a predetermined mount position in the image forming apparatus;

a holding member for holding the unit to allow displacement of the unit relative to the positioning member;

a restricting and releasing mechanism for restricting or releasing the displacement of the unit relative to the positioning member; and a cover member for interlocking with the restricting and releasing mechanism to cover or open a specific portion of the unit.

4. The process cartridge as in claim 3, wherein the element comprises a toner container and a developing roller, and wherein the cover member covers or opens the developing roller.

5. A process cartridge which can be mounted on and dismounted from an image forming apparatus, the process cartridge comprising:

a unit comprising an element used for an image forming process;

a positioning member having a positioning portion which engages with an engagement portion formed on the image forming apparatus to position the process cartridge at a predetermined mount position in the image forming apparatus;

a holding member for holding the unit to allow displacement of the unit relative to the positioning member; and a restricting and releasing mechanism for restricting or releasing the displacement of the unit relative to the positioning member, wherein the restricting and releasing mechanism comes into contact with a member provided on the image forming apparatus and operates.

6. The process cartridge as in claim 5, wherein the restricting and releasing mechanism operates when the process cartridge is mounted on and dismounted from the image forming apparatus.

7. The process cartridge as in claim 5, wherein the restricting and releasing mechanism operates when the process cartridge is mounted on the image forming apparatus.

8. A process cartridge which can be mounted on and dismounted from an image forming apparatus, the process cartridge comprising:

a unit comprising an element used for an image forming process;

a positioning member having a first positioning member which engages with an engagement portion formed on the image forming apparatus to position the process cartridge at a first predetermined position in the image forming apparatus; and a first pressed portion which is pressed by a first press portion provided on the image forming apparatus when the process cartridge is moved from the first predetermined position to a second predetermined position to position the process cartridge at the second predetermined position, wherein the first pressed portion is provided on the positioning member.

9. A process cartridge which can be mounted on and dismounted from an image forming apparatus, the process cartridge comprising:

a unit comprising an element used for an image forming process;

a positioning member having a first positioning member which engages with an engagement portion formed on the image forming apparatus to position the process cartridge at a first predetermined position in the image forming apparatus;

a first pressed portion which is pressed by a first press portion provided on the image forming apparatus when the process cartridge is moved from the first predetermined position to a second predetermined position to position the process cartridge at the second predetermined position; and a second pressed portion which is pressed by a second press portion provided on a cover of the image forming apparatus when closing the cover, the process cartridge being positioned at the first predetermined position by pressing the second press portion on the second pressed portion.

10. The process cartridge as in claim 9, wherein the second pressed portion is provided on the positioning member.

11.The process cartridge as in claim 10, wherein the second pressed portion is the first pressed portion.

12. The process cartridge as in claim 9, further comprising a third pressed portion which is pressed by a third press portion provided on the image forming apparatus when the process cartridge is moved from the second predetermined position to a third predetermined position to position the process cartridge at the third predetermined position.

13. The process cartridge as in claim 12, wherein the pressing direction by the third press portion is substantially perpendicular to the pressing direction by the first press portion.

14. The process cartridge as in claim 12, wherein when the process cartridge is positioned at the third predetermined position, and the first and second pressed portions are not pressed by the first and second press portions.

15. The process cartridge as in claim 9, wherein the pressing direction by the first and second press portions are identical to the direction that the process cartridge is mounted on the image forming apparatus.

16. An image forming apparatus, comprising:

a process cartridge comprising:

a unit comprising an element used for an image forming process;

a positioning member having a positioning portion;

a holding member for holding the unit to allow displacement of the unit relative to the positioning member; and a restricting and releasing mechanism for restricting or releasing the displacement of the unit relative to the positioning member;

an image forming unit for forming an image using the element of the process cartridge;

an engagement portion which engages with the positioning member of the process cartridge to position the process cartridge at a predetermined mount position in the image forming apparatus; and a cover member for interlocking with the restricting and releasing mechanism to cover or open a specific portion of the unit.

17. The image forming apparatus as in claim 16, wherein the element comprises a toner container and a developing roller, and wherein the cover member covers or opens the developing roller.

18. An image forming apparatus, comprising:

a process cartridge comprising:

a unit comprising an element used for an image forming process;

a positioning member having a first positioning member; and a first pressed portion;

an image forming unit for forming an image using the element of the process cartridge;

an engagement portion which engages with the positioning member of the process cartridge to position the process cartridge at a first predetermined position in the image forming apparatus; and a first press portion for pressing the first pressed portion of the process cartridge when the process cartridge is moved from the first predetermined position to a second predetermined position to position the process cartridge at the second predetermined position, wherein the first pressed portion is provided on the positioning member.

19. An image forming apparatus, comprising:

a process cartridge comprising:

a unit comprising an element used for an image forming process;

a positioning member having a first positioning member; and a first pressed portion;

an image forming unit for forming an image using the element of the process cartridge;

an engagement portion which engages with the positioning member of the process cartridge to position the process cartridge at a first predetermined position in the image forming apparatus; and a first press portion for pressing the first pressed portion of the process cartridge when the process cartridge is moved from the first predetermined position to a second predetermined position to position the process cartridge at the second predetermined position, wherein the process cartridge further comprises a second pressed portion, and wherein the image forming apparatus further comprises a cover and a second press portion is provided on the cover, whereby when closing the cover, the process cartridge is positioned at the first predetermined position by pressing the second press portion on the second pressed portion.

20. The image forming apparatus as in claim 19, wherein the second pressed portion is provided on the positioning member.

21. The image forming apparatus as in claim 19, wherein the process cartridge further comprises a third pressed portion, and wherein the image forming apparatus further comprises a third press portion pressing the third pressed portion when the process cartridge is moved from the second predetermined position to a third predetermined position to position the process cartridge at the third predetermined position.

22. The image forming apparatus as in claim 21, wherein the pressing direction by the third press portion is substantially perpendicular to the pressing direction by the first press portion.

* * * * *